US006327804B1

(12) United States Patent
Shaw

(10) Patent No.: US 6,327,804 B1
(45) Date of Patent: Dec. 11, 2001

(54) GARDEN MARKER STAKE FOR DISPLAYING SEED PACKETS

(76) Inventor: James H. Shaw, 21290 SW. Kruger Rd., Sherwood, OR (US) 97140

( * ) Notice: Subject to any disclaimer, the term of this patent is extended or adjusted under 35 U.S.C. 154(b) by 0 days.

(21) Appl. No.: 09/187,820

(22) Filed: Nov. 6, 1998

(51) Int. Cl.[7] ..... G09F 23/00

(52) U.S. Cl. ..... 40/645; 40/649; 40/661; 40/661.08; 47/44; 47/47

(58) Field of Search ..... 40/645, 649, 654.01, 40/661, 661.08; 47/44, 47

(56) References Cited

U.S. PATENT DOCUMENTS

| | | | | |
|---|---|---|---|---|
| 2,143,869 | * | 1/1939 | Donald | 40/661 X |
| 2,181,977 | * | 12/1939 | Magovern | 40/645 |
| 2,207,180 | * | 7/1940 | Smith et al. | 40/645 |
| 2,461,054 | * | 2/1949 | Green | 40/645 |
| 2,595,530 | * | 5/1952 | Kuefner | 40/645 |
| 2,835,994 | * | 5/1958 | Kuefner | 40/645 |
| 3,098,320 | * | 7/1963 | Estkowski | 40/645 X |
| 4,027,410 | * | 6/1977 | Wheeler | 40/645 |
| 4,079,530 | | 3/1978 | Atherton et al. . | |
| 4,196,533 | * | 4/1980 | Kamphausen | 40/645 |
| 4,304,059 | | 12/1981 | Tisbo et al. . | |
| 4,534,125 | | 8/1985 | Buck . | |
| 5,537,768 | * | 7/1996 | Tesselaar et al. | 40/645 |
| 5,595,009 | | 1/1997 | Rummer . | |

FOREIGN PATENT DOCUMENTS

| | | | | |
|---|---|---|---|---|
| 352927 | * | 1/1990 | (EP) | 40/645 |
| 260200 | * | 10/1926 | (GB) | 40/645 |
| 412003 | * | 6/1934 | (GB) | 40/645 |
| 430354 | * | 11/1934 | (GB) | 40/645 |

* cited by examiner

*Primary Examiner*—B. Dayoan
*Assistant Examiner*—Andrea Chop
(74) *Attorney, Agent, or Firm*—Chernoff, Vilhauer, McClung & Stenzel, LLP

(57) ABSTRACT

A garden marker device has a cover, a back and a stake. The cover is transparent and has a periphery bounded by a top margin, a bottom margin and a pair of side margins. The back is connected to the top margin and the pair of side margins of the cover, so as to define an enclosure between the cover and the back extending between the side margins. The stake is connected to the back.

9 Claims, 2 Drawing Sheets

10
22
4
20
11
SEEDS
18
28
26
12
3
3
24
38
4
40
16
34a
34c
34
34b
36

20
22
18
12
14
16
32
24
30

34b
16
34c
34a
34
14
18
28
26
12

GARDEN MARKER STAKE FOR DISPLAYING SEED PACKETS

BACKGROUND OF THE INVENTION

The present invention is directed to a garden marker stake for displaying seed packets. Particularly, the invention relates to a garden marker stake that allows for the visible storage of an informational placard, such as a display label or a seed packet, in a protected environment for identifying the vegetation planted.

In the past, gardeners have used a variety of marker stakes that have the identities of the plants embossed thereon, or have seed packs, or the like, attached thereto. In such marking devices, the indicia can be washed away due to weather-related damage and/or watering of the plants. With the susceptibility to weather and related damage, the viability of the identifying indicia is reduced and thereby diminishes the marking function and whole purpose of the garden marker stake.

Garden marker stakes have been the subject of several patents, but none of them provide the advantages of the instant invention. Buck, U.S. Pat. No. 4,534,125 discloses a hollow clear plastic body and a stake, molded together of plastic so that a seed packet held within the display portion is visible from all sides. A snap-on cap is provided for the top of the display container, and a hole is provided at the bottom to allow moisture to drain. The disclosed garden marker stake has the disadvantage that it is a bulky structure of somewhat complex design, and does not provide a seal around the top to prevent entry of water from rain or irrigation.

Rummer, U.S. Pat. No. 5,595,009 discloses a transparent cover on a holder for seed packets mounted on the top of a thin cylindrical stake. The device has a hinged flap which is expensive to manufacture and subject to damage in the field. The assembly of the various pieces of the marker disclosed in Rummer also increases the cost of making the device. In addition, the thin supporting stake in Rummer does not securely anchor the garden marker in soil.

Tisbo, U.S. Pat. No. 4,304,059 discloses a molded plastic stake together with a frame with tabs to hold a seed bag exposed to view. The device does not provide protection against water damage from rain or irrigation for a seed packet held in the frame, and the frame is critical as to seed packet size.

Atherton, U.S. Pat. No. 4,079,530 shows a device made of apparently opaque material with an open display area on only one side of the upper portion. In one version of the device seed packets can be inserted into a slot at the top of the upper, or display portion, while in another version of the device the front and back of the upper portion must be separated for a seed packet to be inserted. The device thus does not provide good visibility of the displayed seed packet, and further subjects the seed packet to rain or water damage through the frame and/or the upper slot.

What is therefore desired is a garden marker stake for holding a seed packet or display label that provides excellent visibility of the seed packet or the display label that is simple and easy to manufacture, that is able to withstand exposure to rain and water from irrigation, that holds display labels or seed packets of a wide range of sizes, and that may be anchored securely in soil.

SUMMARY OF THE INVENTION

The garden marker device has a cover, a back and a stake. The cover is transparent and has a periphery bounded by a top margin, bottom margin and a pair of side margins. The back is connected to the top margin and the pair of side margins of the cover, so as to define an enclosure between the cover and the back extending between the side margins. The stake is connected to the back.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
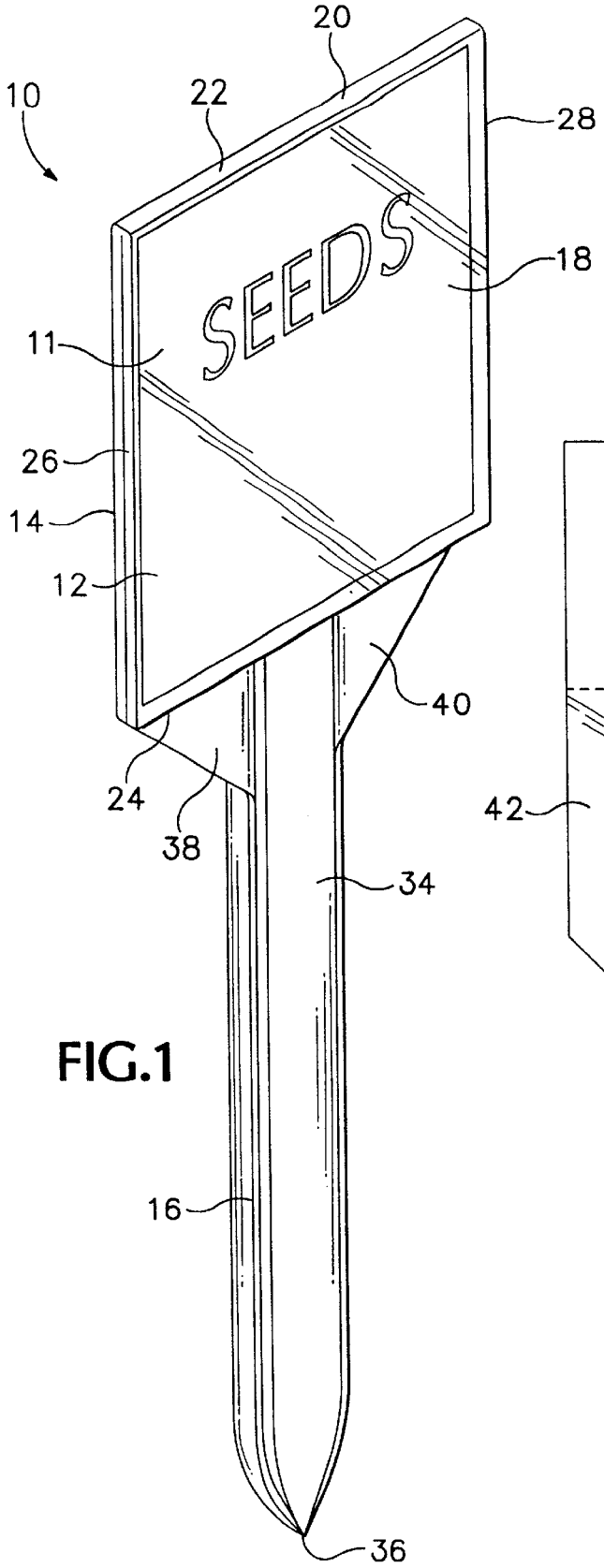
FIG. 1 is a perspective view of an exemplary embodiment of a garden marker device constructed in accordance with the present invention.

With reference to FIGS. 1, 2, 3 and 4 wherein like numerals refer to like elements, an exemplary embodiment of the garden marker device of the present invention comprises a garden marker device 10 having a cover 12, a back 14 and a stake 16. A display label 18 is located between the cover 12 and back 14. As used herein, display label 18 includes seed packets, placards, or any other information bearing labels commonly used by gardeners or nurserymen. The cover 12 and the back 14 together comprise the display portion 11. The cover 12 has a periphery 20 bounded by a top margin 22, a bottom margin 24 and a pair of side margins 26 and 28.

The back 14 is connected to the cover 12 to form an enclosure 30 for receiving the display label 18. Preferably, the back 14 is connected to the cover 12 along a major portion of the periphery 20, so as to prevent water from rain or irrigation from damaging the display label 18. The back 14 may be connected along the entire extent of the top margin 22 so as to completely enclose the top of the garden marker stake 10 to prevent entry of water from rain or irrigation. The back 14 is also connected to the cover along the pair of side margins 26 and 28. The back may be connected along the entire extent of side margins 26 and 28, again to form a seal so as to prevent entry of water from rain or irrigation through the sides of the garden marker device. Nevertheless, gaps or spaces may be present along the periphery 20 without defeating the purpose of the invention.

The enclosure 30 extends between the two side margins 26 and 28. The enclosure 30 may extend to the bottom margin 24 of the cover 12, but could also end above the bottom margin 42 depending on the overlapping relationship between the cover 12 and the back 14. The enclosure 30 formed between the cover 12 and the back 14 receives the display label 18. The display label 18 may be inserted into the enclosure 30 and pushed upwards toward the top margin 22. The cover 12 and the back 14 frictionally hold the display label 18 in place within the enclosure 30.

Alternatively, the display label 18 could be held in place by structural means such as a ledge or a lip on the inside of the cover 12 or the back 14 or by means of clips or other fastening devices. The back 14 directly opposes a major portion of the cover 12 to provide protection to the display label 18 and to securely hold the display label 18 in place. The back 14 may be the same size as the cover 12, but could be larger or smaller.

The dimensions of the garden marker device may be selected to suit the user's particular needs. Seed packets are typically sold in widths of approximately 3 inches or 5 inches, and thus a top margin of 5 inches will generally accommodate most seed packets. The dimensions of the stake need only be such to provide sufficient rigidity to allow insertion of the stake into garden soil. The thickness of the plastic material should be selected to provide sufficient rigidity to the stake, and may vary according to the material selected.

The cover 12 is made from a transparent material, which allows for viewing of the display label 18. Preferably, the back 14 is also made from the same piece of transparent material, so that the front and back sides of the display label 18, as in a seed packet, may be conveniently viewed. Transparent materials suitable for use in the present invention include any suitable clear, durable plastic. The use of such transparent material provides a significant advantage over prior art garden marker devices which utilize printed informational material on the marker itself, since the transparent material allows the garden marker device of the present invention to be reused by simply replacing the informational material.

The stake 16 is integrally connected to the back 14. A top portion 32 of the stake 16 directly opposes the cover 12. The stake 16 defines an elongate channel 34 extending away from the back 14. The channel 34 provides reinforcement to the stake 16 so as to provide rigidity to the stake 16. The channel 34 also provides stability of the garden marker device when placed in soil, preventing lateral or side-to-side movement. The channel may be of any shape that generally defines a valley or trough. The channel 34 shown in FIGS. 1–4 has three walls 34*a*, 34*b* and 34*c*, but alternatively, the channel 34 could have a "U" shape or a "V" shape. The stake 16 terminates in a point 36. The point 36 further facilitates planting of the garden marker device 10 in soil. The top portion 32 of the stake 16 which directly opposes cover 12 provides additional support and stability to the display portion 11. By extending partially above the bottom margin 24, the top portion 32 of the stake 16 helps to prevent bending of the display portion 11 relative to the stake 16. In addition, the top portion 32 provides an opening behind the cover 12 and extending above the bottom margin 24 to facilitate pushing the display label 18 into the enclosure 30 or retrieving the display label 18 from the enclosure 30.

The garden marker device 10 further includes a pair of lateral supports 38 and 40. These lateral supports 38 and 40 extend between the upper portion of the stake 16 and the bottom of the back 14. Preferably, the lateral supports 38 and 40 each comprise a triangularly shaped portion of material, with one margin of the lateral support integrally connected along a portion of the stake 16, and another margin of the lateral support integrally connected to a portion of the back 14. The lateral supports 38 and 40 provide additional rigidity to the display portion 11, to prevent side to side or bending movement of the display portion 11 relative to the stake 16.

Figure 5:
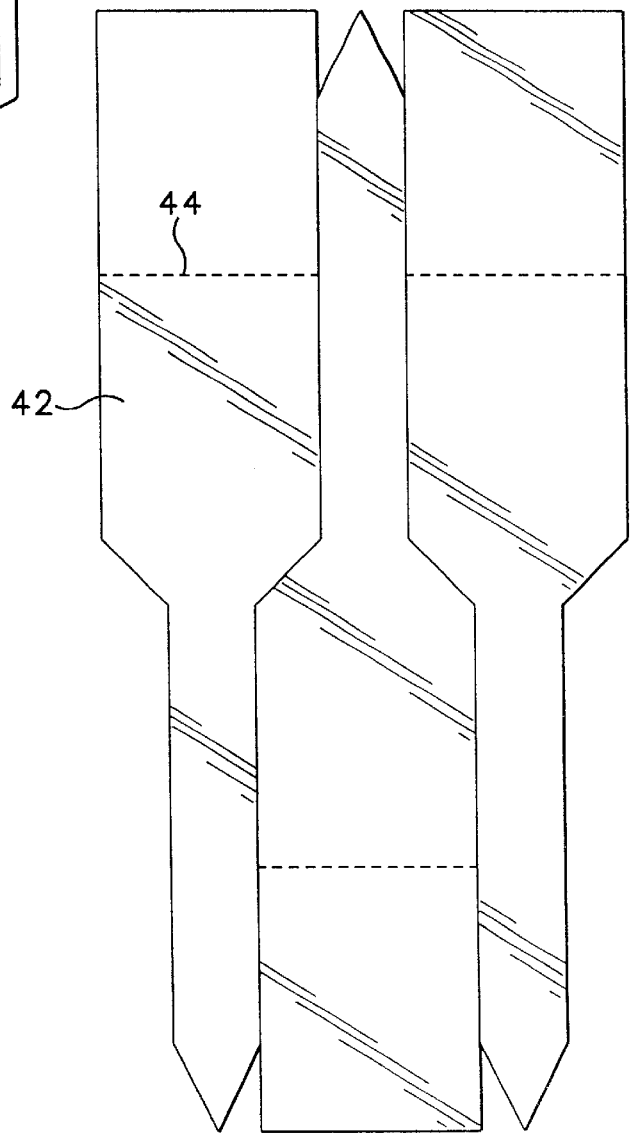
FIG. 5 is a plan view showing the outline of shapes used to form the garden marker devices cut from a sheet of material.
Figures 2, 3, 4:
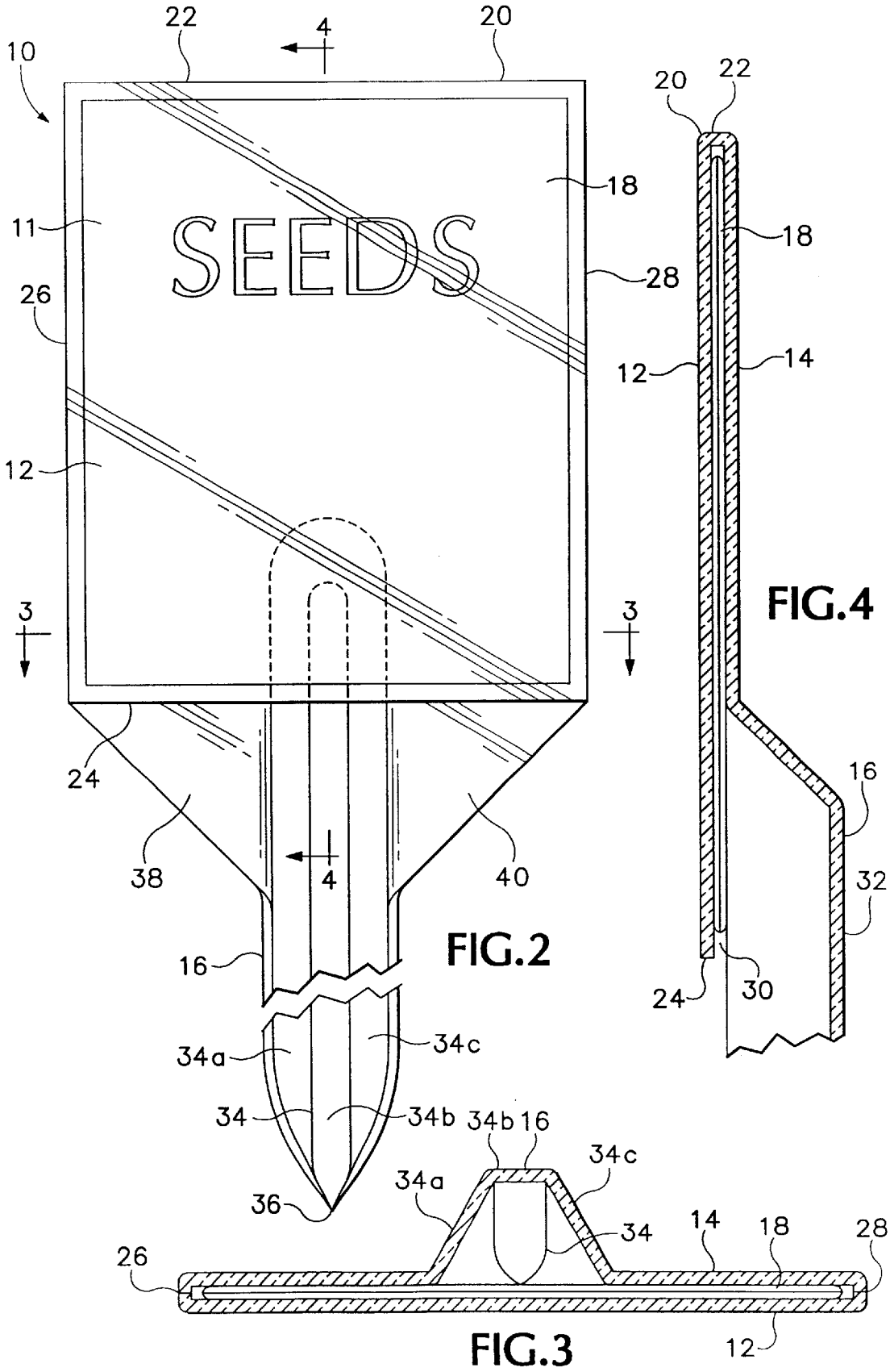
FIG. 2 is a front view of the garden marker device of FIG. 1.
FIG. 3 is a sectional view of the garden marker device of FIG. 1 along the line 3—3 of FIG. 2.
FIG. 4 is a sectional view of the garden marker device of FIG. 1 along the line 4—4 of FIG. 2.

The garden marker device 10 of the present invention may be manufactured from a single sheet of transparent material, such as a durable plastic. First, a sheet of material is cut, for example by die stamping, to yield a shape 42. FIG. 5 illustrates an example of how the sheet of material may be cut to shape, showing several shapes 42, each of which will be formed into the garden marker device 10 of the present invention. After the shape 42 is cut from the sheet of material, channel 34 is formed in stake 16. The cover 12 is then folded relative to the back 14 along the top margin 22 (illustrated as the dashed line 44 in FIG. 5). The side margins 26 and 28 of the cover 12 may then be fastened to the back 14 by any suitable means, such as gluing the cover 12 to the back 14, by applying heat to melt the plastic along the side margins 26 and 18, or by mechanical fastening means such as screws or pins. Alternatively, the cover 12 could be cut as a separate piece from a sheet of material. The top margin 22 thus would be sealed using glue, by applying heat, or by mechanical means, as would side margins 26 and 28. Alternatively, the garden marker device 10 of the present invention may be manufactured by molding or other suitable means.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A garden marker device, comprising:

(a) a cover, a back and a stake;

(b) said cover being transparent and having a periphery bounded by a top margin, a bottom margin and a pair of side margins;

(c) said back being connected to said top margin and said pair of side margins of said cover, so as to define an enclosure between said cover and said back extending between said side margins suitable for receiving a display label;

(d) said stake being connected to said back;

(e) said cover, said back and said stake are formed of a single sheet of transparent material, and said top margin of said cover is formed by a fold line of said transparent materiaL; and (f) wherein said stake defines a channel in communication with said enclosure.

2. The garden marker device of claim 1 wherein said back is connected to said cover along a major portion of said periphery.

3. The garden marker device of claim 1 wherein said stake defines a V-shaped channel.

4. The garden marker device of claim 1 wherein said back directly opposes a major portion of said cover.

5. The garden marker device of claim 1 wherein a portion of said stake directly opposes a portion of said cover.

6. The garden marker device of claim 1, further comprising a pair of lateral supports extending between said stake and said back, said back being substantially planar and said lateral supports being planar and in substantially the same plane as that defined by said back.

7. The garden marker device of claim 1 wherein said enclosure extends to said bottom margin of said cover.

8. The garden marker device of claim 1 wherein said back and said top margin of said cover are interconnected to form a water tight seal along said top margin.

9. A garden marker device, comprising:

(a) a cover, a back and a stake, said cover and said back being suitable to protect a display label from water damage;

(b) said cover being transparent and having a periphery bounded by a top margin, a bottom margin and a pair of side margins;

(c) said back and said cover defining an enclosure between said cover and said back extending between said side margins suitable for receiving a display label at an opening at said bottom margin;

(d) said stake being connected to said back proximate to said opening; and (e) wherein said stake defines a channel in communication with said enclosure.

* * * * *